United States Patent [19]

Tompkins

[11] Patent Number: 4,496,076

[45] Date of Patent: Jan. 29, 1985

[54] MULTIPLE BLAST AERATOR SYSTEM

[75] Inventor: L. Kirk Tompkins, Little Rock, Ark.

[73] Assignee: Global Manufacturing Co. Inc., Little Rock, Ark.

[21] Appl. No.: 369,100

[22] Filed: Apr. 16, 1982

[51] Int. Cl.[3] ..... B65D 88/72

[52] U.S. Cl. ..... 222/3; 222/195; 366/106; 366/107; 406/85; 406/137

[58] Field of Search ..... 222/1, 3, 195, 399, 222/637, 161, 196; 406/85, 137; 366/101, 106, 107, 3; 414/288

[56] References Cited

U.S. PATENT DOCUMENTS

| | | | |
|---|---|---|---|
| 2,353,346 | 7/1944 | Logan | 222/195 X |
| 2,714,043 | 7/1955 | Glaza | 406/137 |
| 3,482,882 | 12/1969 | Sem | 406/137 |
| 3,653,639 | 4/1972 | Mueller | 406/85 X |
| 3,830,548 | 8/1974 | Sem | 222/161 X |
| 4,051,982 | 10/1977 | Stetson | 222/3 X |
| 4,165,820 | 8/1979 | Dugge et al. | 222/195 X |
| 4,197,966 | 4/1980 | Wadensten et al. | 222/1 |
| 4,325,495 | 4/1982 | Mokris | 222/195 X |

FOREIGN PATENT DOCUMENTS

| | | | |
|---|---|---|---|
| 216987 | 11/1967 | Sweden | 222/195 |
| 1426035 | 2/1976 | United Kingdom . | |

*Primary Examiner*—Joseph J. Rolla
*Assistant Examiner*—Kevin P. Shaver
*Attorney, Agent, or Firm*—Stephen D. Carver

[57] ABSTRACT

A multiple blast aerator hopper system for handling bulk material. A plurality of blast aerators are fitted at radially spaced-apart intervals about the periphery of the hopper; the first blast aerator is positioned near the bin outlet, and each succeeding aerator is usually vertically elevated thereabove. The blast aerators are periodically fired in a timed, rotary sequence starting with the first, lowermost aerator and continuing serially with higher, radially spaced-apart aerators. Preferably each aerator includes an internal valve seat assembly which houses a resilient, dual diameter piston for axial movement between the sealing position and a rearward, aerator fill position. An external solenoid valve controls each aerator. Preferably the blast discharges of each aerator are directed downwardly, tangentially with respect to the walls of the bin or hopper on which the system is mounted.

7 Claims, 9 Drawing Figures

FIG. 4
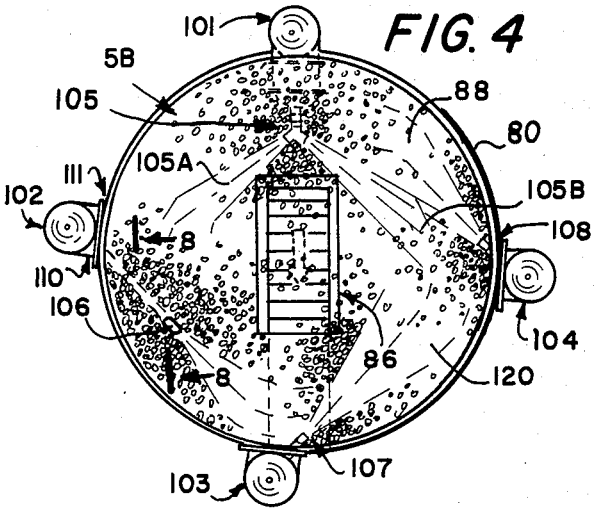
FIG. 6
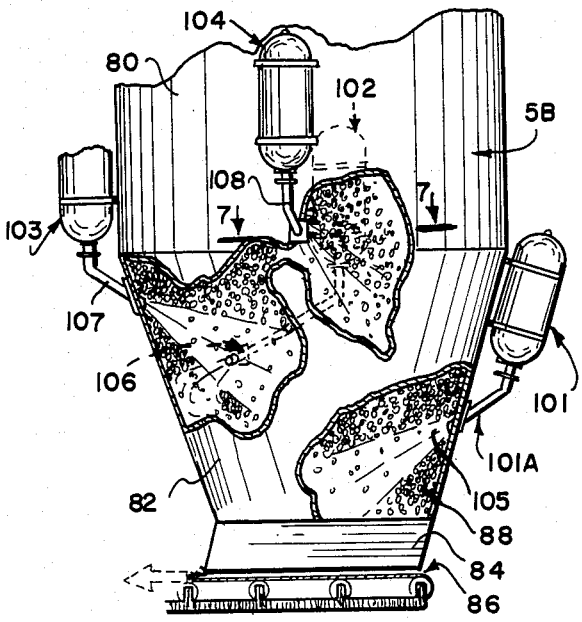
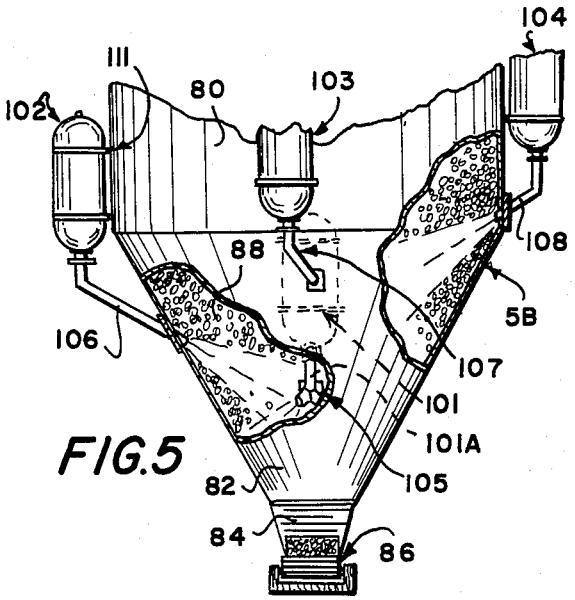
FIG. 5
FIG. 7
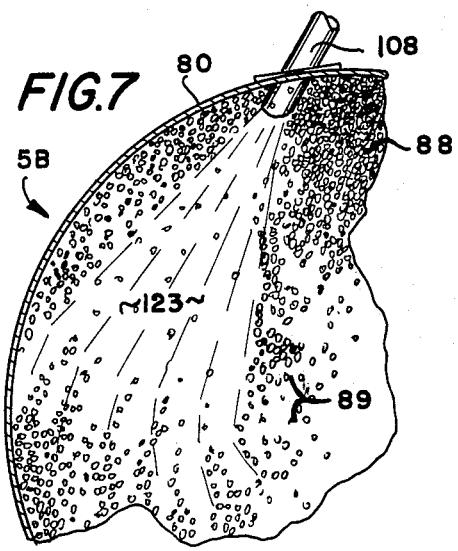
FIG. 8
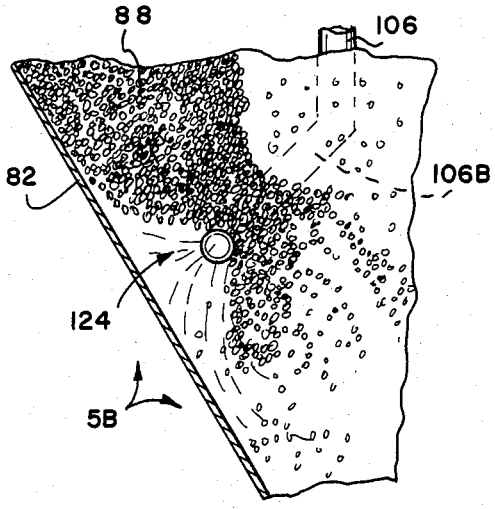

MULTIPLE BLAST AERATOR SYSTEM

BACKGROUND OF THE INVENTION

The present invention relates generally to blast aerator technology of the type adapted to insure the flow of bulk materials within bins, hoppers or the like. More particularly, the present invention is concerned with a multiple blast aerator system which is appropriately timed to induced seqential detonation of the aerators to promote bulk material transfer.

It is well known that in handling or processing bulk materials such as cement, coal, wood chips or the like the hoppers or storage bins employed often become jammed or temporarily blocked. Such materials may tend to cake or congeal during bulk processing, particularly with the natural phenomenon of first in last out flow of a single discharge hopper. Previously it has been suggested to remedy bulk flow problems by physically vibrating the hopper or container to shake materials loose, but not all materials may be dislodged in this manner. For example, large concrete bunkers may be impossible to vibrate. Furthermore, some materials like soft wood chips ordinarily absorb vibratory energy and must be dislodged by other methods.

Various phenomena occur during the processing of bulk materials through conventional conically shaped hoppers. For example, bridges or arches of materials often form, preventing the escape of material above the arch. Often "rat holes" or funnels occur when material immediately above the hopper exits drops through, while remaining material bunches up on top. Particles of material may form cohesive bonds either by adhesion due to chemical or hydrostatic attraction, or particles may interlock because of horizontal and vertical compression thereof. Also, friction between the massive material stored in the bunker or hopper and the walls thereof tends to prevent proper flowage. Because of these and other phenomena associated with bulk processing, a plurality of air blaster or blast aerator designs have been previously proposed.

Blast aerators periodically introduce a large blast of air into the hopper to dislodge material. The volume of compressed air released by the quick opening valve normally employed with blast aerators strikes the material at a rate of over six hundred feet per second. Materials directly adjacent to or in front of the discharge outlet of the aerator are forcibly dislodged by the impact. When the large volume of air outputted by the aerator enters the bin, the air continues to expand during and after the impact phase of the discharge. This greatly stimulates and disturbs the materials within the hopper. Blast aerators characterized by the foregoing observations may be seen in U.S. Pat. Nos. 3,915,339; 4,197,966; and 3,651,988. Other relevant blast aerator technology may be seen in Great Britain Pat. Nos. 1,426,035 and 1,454,261. Also relevant are West German Patent 2,402,001 and Australian Pat. No. 175,551.

Air blasters are generally more efficient than other methods of dislodging jammed, bulk materials since the force outputted by them is applied directly to the material, rather than to the walls of the structure, as in the case of vibrators. Blasters also have an advantage of impact against the material, which is not available from air slides air wands, and various air screen devices which inject low pressure air into the material. Live bottoms in hoppers or bins are limited in their effectiveness, since they may tend to create bridging or arching of material. However, air blasters are intended for use only as a flow stimulator from materials which are primarily moved by the force of gravity. They are not intended to be the prime movers of material, and should not be used to initiate flow or movement of material when gravity feed is not used. .

In operation, the mechanical parts of the aerator will encounter extremely high stresses which tend to promote component failure. For example, piston wear and tear is a large problem. In prior art designs that portion of the piston utilized to create a seal also functions as the working surface upon which tank pressure works to force the piston to its rearward "blast" position. Thus, as explained in my co-pending patent application, Ser. No. 354,310, filed Mar. 03, 1982, and entitled Blast aerator, a dual diameter piston would seem desirable.

Traditionally aerator discharge pipes enter the hopper at a perpendicular angle. This method has several disadvantages. First, material to the rear of the blast aerator discharge orifice may remain unaffected, creating pillars or columns of material which may support arching above the discharge pipes. Also, perpendicular mounting of the blast output pipe results in the formation of tunnels which are forced through the material by the blast. Often the discharged air will escape through the "rat hole" or tunnel which comprises the path of least resistance, rather than dissipating its force by dislodging particles. Thus, it is desirable to avoid dissipation of the air blast within the openings or caverns within the hopper. Moreover, it is desirable to dissipate the blast of the aerator within the materials stored within the hopper to reduce the noise experienced by operating personnel.

SUMMARY OF THE INVENTION

The present invention comprises a multiple blast aerator system for dislodging bulk materials within hoppers. The system is ideal with hoppers of conventional construction. Such hoppers comprise a generally upright, rigid storage bin having a bottom in the form of an inverted cone. A plurality of blast aerators are mounted at radially spaced-apart intervals about the periphery of the hopper. The first aerator is mounted near the bottom or outlet of the bin and each successive aerator is elevated above the preceeding aerator.

The aerators function to intake and store a high pressure charge of air. Periodically a timing pulse actuates a solenoid to detonate the aerator, whereupon a high impact blast of air is discharged directly into the hopper through a suitable blast discharge pipe which penetrates the walls thereof. Unlike prior art systems, the blast discharges of the aerators are directed at tangential, downwardly inclined angles within the bin. Preferably, the first blast aerator is directed in two divergent directions, both of which angle downwardly, tangentially with respect to the interior walls of the bin.

A blast aerator ideal for practice of the present invention is seen in my co-pending patent application, Ser. No. 354,310, filed 03/03/82. In summary, the aerator includes a blast output pipe including an output end which projects outward from the rigid, generally cylindrical aerator tank. An internal shoulder of the output pipe maintains a valve seat assembly in correct operative position. A resilient, cylindrical dual diameter piston is slidably disposed within an intermediate portion of the discharge pipe, and is axially displaceable between an aerator fill position and an aerator discharge position. In the fill position the seal is maintained when the chamfered end of the reduced diameter piston portion matingly, sealingly contacts a similarly chamfered seat portion of the valve seat assembly.

Air is introduced to the aerator through a valve control system mated to the end cap of the blast control pipe. Air introduced into the cavity between the rear of the piston and the end cap urges the piston into sealing engagement with the seat assembly, and air escapes from the cavity through a check valve secured to the end plate to fill the tank. After the tank is thus pressurized, an electric solenoid valve depressurizes the cavity to allow the piston to move rearwardly. At this time interior tank pressure acts upon the piston's shoulder, forcing it into a rearward position, thereby exposing the blast pipe. Virtually instantaneously air stored within the tank is rapidly vented through the blast output into the hopper.

The system of the present invention contemplates the firing of aerators in repeated, rotary sequence whereby to distribute air blasts in a highly efficient manner, creating the maximum disturbance possible.

Thus a broad object of the present invention is to provide a multiple blast aerator system for reliably and continuously agitating and freeing bulk materials within a hopper, storage bin or the like.

A similar object of the present invention is to provide a hopper system capable of inducing maximum disturbance in the bulk material stored therewithin.

Another object is to utilize to the fullest extent possible the impact, volume, and expansion characteristices of the air blast outputted by a blast aerator.

A still further object of the present invention is to extract maximum work energy from the air blast outputted by a blast aerator.

A related object of the present invention is to "lever" blocked bulk material away from the hopper wall by directing air between the wall and the material to be dislodged.

Yet another object of the present invention is to form an air slide by appropriately directing the blast pathway thereby to relieve the cohesion between the inner walls of the hopper and the material stored therewithin.

Another object of the present invention is to reduce the noise (the loud report) generated by the discharge of the aerator by combining the blast within materials to be dislodged.

A related object is to harness the full force of the discharged air by delaying it from reaching the interior "tunnel" or "open air". In other words, the blast is prevented from finding an easy exit; it is directed into the material peripherally, tangentially with respect to the walls of the hopper.

A more basic object of the present invention is to continuously shear the material that traditionally clings to the walls of the hopper.

A still further object of the present invention is to provide a blast aerator design ideally adapted for multiple aerator installations of the type described herein.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout to indicate like parts in the various views:

FIG. 4 is a sectional view taken through a typical cylindrical hopper having a tapered, lower frusto conical portion which terminates in a rectangular opening, illustrating the preferred, radially spaced-apart blast aerator positions;

FIG. 5 is a front view of the apparatus of FIG. 4, with parts thereof broken away or shown in section for clarity;

FIG. 6 is a side view thereof, with parts broken away or shown in section for clarity;

FIG. 7 is an enlarged fragmentary sectional view taken generally along line 7—7 of FIG. 6 illustrating an instance of particle shearing;

FIG. 8 is an enlarged vertical sectional view illustrating the phenomena of particle shearing; taken generally along line 8—8 of FIG. 4; and, FIG. 9 is a block diagram of the timing control apparatus.

DETAILED DESCRIPTION OF THE DRAWINGS

Figure 1:
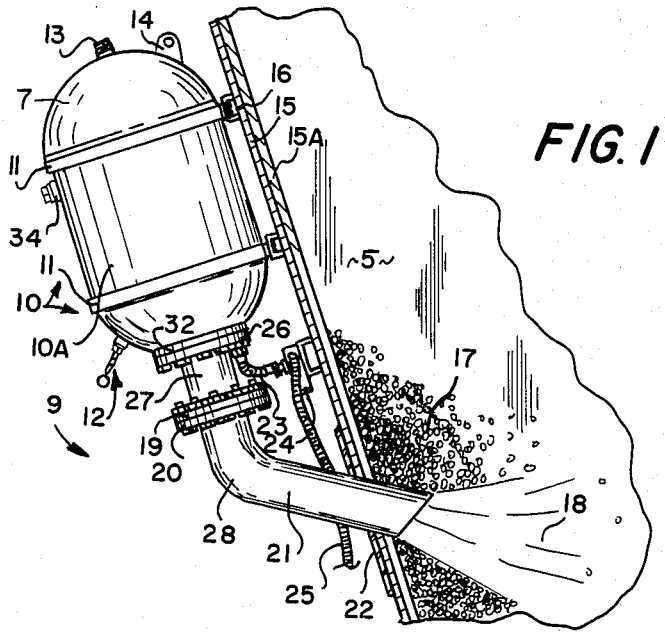
FIG. 1 is a fragmentary pictorial view illustrating operational placement of a blast aerator in accordance with the teachings of this invention upon a hopper or storage bin, with parts thereof broken away for clarity.
Figure 2:
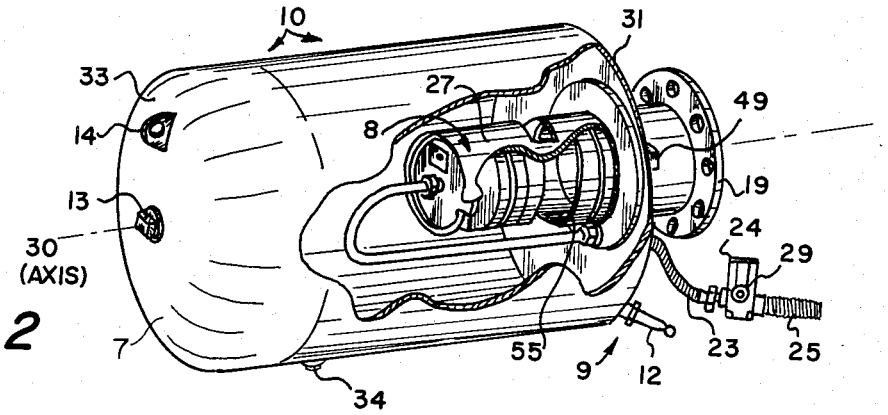
FIG. 2 is a fragmentary, isometric view of a blast aerator ideally adapted for practice of the present invention, with parts thereof broken away or shown in section for clarity.
Figure 3:
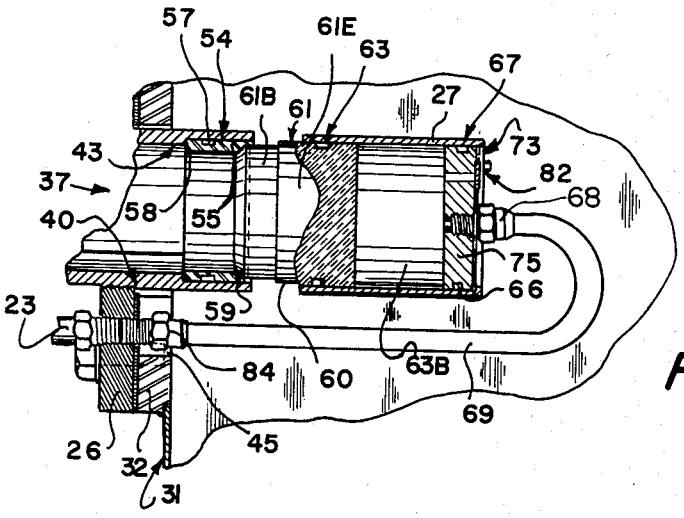
FIG. 3 is an enlarged, fragmentary side view of an assembled blast discharge pipe assembly employed with the aerator ideally employed with the present invention, with the dual diameter piston thereof shown in the aerator fill position.

With reference now to FIGS. 1-3 of the drawings, a blast aerator ideally adapted for use with the teachings of the present invention is generally designated by the reference numeral 10. Aerator 10 is the subject of my co-pending patent application, Ser. No. 354,310, filed Mar. 3, 1982.

Aerator 10 comprises a rigid, generally cylindrical, preferably steel tank 10A secured to a suitable hopper 5 (or other application) by a pair of conventional, spaced-apart mounting straps 11. Straps 11 are secured by mounting cradles 16 to hopper walls 15. Bulk material, generally designated by the reference numeral 17, is disposed within hopper 5 within wall liner 15A and is periodically agitated by an air blast, generally designated by the reference numeral 18.

The front 9 of the tank 10A preferably includes a pressure relief valve 12, which is aimed downwardly such that it will facilitate drainage of the tank interior when necessary. Preferably an end plug 13 of conventional construction is disposed at the rear 7 of the tank. A blast control pipe system, generally designated by the reference numeral 8 (FIG. 2) is mechanically coupled coaxially within the tank 10A at its front 9. The tank head 31 mounts a tank flange 32 which is coaxially positioned relative to axis 30. Optional side plug 34 is provided to permit drainage of the tank. Installation of the aerator 10 is facilitated by a tab 14 which facilitates lifting by a conventional hoist or the like.

The blast pipe apparatus 8 includes an elongated, substantially tubular body 27 which terminates in appropriate pipe threads for mounting a pair of spaced-apart flanges 19, 26. Flange 19 is coupled to a conventional terminal flange 20 secured to a discharge pipe 21 which enters the interior of hopper 5 at a downwardly inclined angle. A wall flange mounting 22 is provided for mechanical strength. A long radius bend, generally designated by the reference numeral 28, has been advantageous in actual use.

The blast pipe apparatus 8 includes a cylindrical valve piston seat assembly, generally designated by the reference numeral 54. Seat 55 is chamfered at approximately forty five degrees. The piston seat assembly 54 is coaxially received within pipe 27, and it preferably includes a conventional O-ring 57 seated within an appropriate O-ring groove.

The resilient dual diameter piston, generally designated by the reference numeral 61, is slidably, coaxially disposed within the tube body 27. The piston includes a front, reduced diameter portion 61B separated from a larger diameter main body portion 61E via shoulder 60, and the leading edges of the reduced diameter piston portion are chamfered, as indicated at 59. Surface 59 mates with similarly chamfered seat 55 to seal the tank interior when filling commences. The piston is slidable between blocking engagement with the piston seat assembly 54 and a rearward position toward end cap 75.

End cap 75 is generally circular in cross section, and is sealed with a conventional O-ring 66. A cavity, generally designated by the reference numeral 63B, is defined within tube 27 between the rear of piston 61 and the front of the end cap 75. Control of the blast aerator may be effectuated by pressurizing or depressurizing cavity 63B.

Air is delivered into cavity 63B via pipe 69 which is suitably threadably fitted to an appropriate orifice with an NPT connector 68. The opposite end of pipe 69 terminates in a forwardly projecting male NPT connector 84 which penetrates tank flange cut out 45 defined through flange 32. An external air line 23 leads to a conventional three-way, normally open electrically activated solenoid valve 24. An external supply of compressed air (not shown) is delivered to the solenoid valve via line 25. The solenoid valve 24 thus controls pressurization of cavity 63B within the blast discharge tube assembly 27. To initiate operation of aerator 10 valve 24 conducts air from tube 25 to tube 23 and pressurizes cavity 63B (and the interior of the tank) via tube 69. A check valve assembly, generally designated by the reference numeral 82, provided at the rear of end cap 75 vents air from cavity 63B to pressurize the interior of the tank 10A. Thus tank 10A will gradually become pressurized until it is equal in pressure to the pressure within cavity 63B. To fire the aerator 10, cavity 63B is depressurized. Solenoid valve 24 is actuated electrically, and when so vented the decreased pressure within cavity 63B will allow the overpressure within tank 10 to act upon piston shoulder 60 to force it rearwardly. Immediately the piston will expose pathway 37, and air will rush out pipe 21 causing the blast 18. Each of the blast aerators preferably employed with the present invention may be constructed along the foregoing lines. The apparatus indicated in FIG. 9, to be later discussed, appropriately energizes each of the aerators in the desired sequence.

Turning now to FIGS. 4—6, hopper 5B includes an upper, generally cylindrical top portion 80 which terminates in a lower portion 82 in the form of an inverted frustrum of a cone. The bottom terminates in a generally rectilinear output mouth 84 ideally positioned above some form of material moving structure, such as a conventional conveyor 86. For purposes of discussion it is to be assumed that each of the blast aerators 101–104 are substantially identical. These blasters are mounted at radially spaced-apart intervals about the circumference of the hopper 5B. As will be appreciated from a comparison of FIGS. 5 & 6, blaster 101 is closest to the hopper mouth 84. The next blaster 102 is elevated somewhat above blaster 101, and blasters 103 and 104 are successively higher than blaster 102. Each of the blasters are mounted to the hopper with the equipment previously described in conjunction with description of blaster 10 (FIGS. 1–3).

The discharge pipe 101A of blaster 101 preferably terminates in a Y-deflector 105 whereby to direct its blast into two, downwardly projecting, generally tangentially oriented discharges 105A and 105B. The associated blasters 102, 103 and 104 discharge tangentially within the hopper 5B at different elevations. Thus the discharge pipe 106 of the blaster 102 (FIG. 4) is aimed tangentially within the hopper, and as seen in FIG. 5, it is also downwardly inclined with respect to the mouth 84. Similarly, the discharge pipe 107 of blaster 103 is angled downwardly (FIG. 6), and it is also oriented tangentially (FIG. 4). The output pipe 108 of blaster 104 similarly enters at a downward angle (FIG. 5) but is aimed tangentially generally towards blaster 101 (FIG. 4). Thus each of the blasters output at angles generally tangential with respect to the inner curved surfaces of the hopper walls. Also, blasters aim generally downwardly towards mouth 84, to encourage proper material discharge.

As used herein the term "tangential" shall be understood to mean a blast direction, as illustrated in FIGS. 4 and 7 for example, wherein the output of the blast aerator is aimed such that the blast pathway divides the circular cross section of the hopper into geometric segments.

With reference now to FIG. 7, it is to be noted that the discharge from blaster 104 via pipe 108 has been generally designated by the reference numeral 123. Since the blast is generally tangential with respect to wall 80, material 89 is "levered" towards the center of the bin. With reference to FIGS. 1, 7, and 8, it will be apparent that each blast forms a "tunnel" by the sudden discharge of air. Material above the tunnel thus drops into the area formed by the blast, and adds weight to the material therebelow, whereby to promote discharge of the bulk material 88. With reference to FIG. 8, it will be noted that discharge pipe 106 includes an angled terminal end 106B which directs the blast tangentially along the lines discussed. Thus blast 124 intersects the surface of the wall of the hopper forcing material toward the central flow route.

The drawings indicate proper placement of air blasters where the problem was severe funneling of the bulk material. In a similar structure with clinging material, the conveyor 86 may move materials away from mouth 84 quite quickly, causing a void in this area. In this case blaster 101 would be located too close to the discharge mouth 84 so that it should be moved 180° from its illustrated location, to disturb the material lodged against the portion of the structure. Blaster 103 would, in the latter case, be relocated to the opposite side of the structure from that illustrated.

Figure 9:
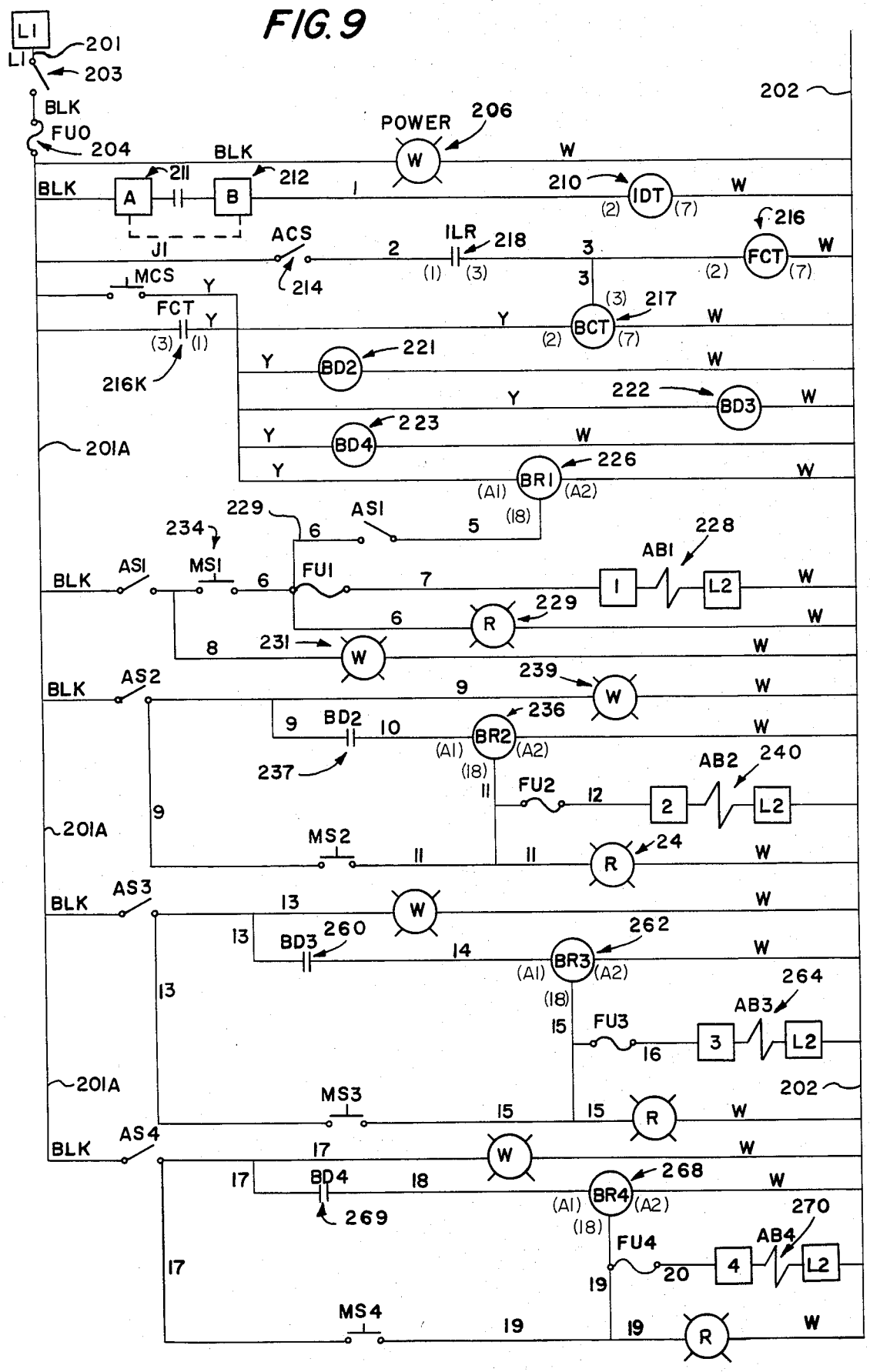

With reference now to FIG. 9, a suitable timing and control circuit is depicted. It must be appreciated that a variety of different circuits of equal utility could be employed in substitution of that illustrated. The purpose of the circuit is to initiate and control multiple blast sequences whereby to fire the blast aerators 101 through 104 in a desired, repetitive timed sequence. The sequence of firing may be varied between individual vibrators, in that the time delay between the firing of successive vibrators is also variable. Moreover, the circuit provides for both manual and automatic control.

Nominally 120 volt alternating current is applied across primary lines 201 and 202. A conventional master switch 203 energizes line 201A through a conventional fuse 204. When switch 203 is closed, operation of the circuit may commense; this fact is registered by conventional indicator lamp 206. An optional interlock delay timer 210 is provided for the customer for control of auxiliary circuits inputted across terrminals 211, 212. An automatic cycle switch 214 initiates full cycle timer 216 when contacts 218 are closed. Initiation of relay 216 will close associated points 216K. Blast control timer 217, initiated by contacts 218 or 216K sets the total time between initiation of the first air blast and the last. It is programmable; its conventional dial must be appropriately set. At this time current will be applied across blast delayed timers 221, 222, 223 and blast relay 226. Delay relays 221–223 delay the firing or aerators 102–104. However, relay 226 immediately energizes the field 228 of that solenoid 224 associated with blaster 101. At this time a red colored indicator light 229 will light. White indicator 231 will indicate when manual detonation of blaster 101 occurs by manual actuation of switch 234.

When delay time 221 times out, blast relay 236 will be fired, when points 237 are closed. Simultaneously indicator 239 will be actuated. The solenoid field 240 of that solenoid 24 associated with blaster 102 will then be actuated, along with red pilot light 242.

Similarly, when blast delay timer 222 times out, contacts 260 will be closed to actuate blast relay 262, energizing field 264 to fire blast aerator 103. Blast delay timer 223 will actuate last relay 268 by closing contacts 269, whereby to energize field 270 and fire aerator 104.

Thus by appropriately setting the control timers automatic repetition of the blast cycles may be repeated at desired intervals. The spacing of blasts between successive aerators is established by blast delay timers 221–223, which can be programmed by the consumer to effectuate the desired cycling.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A multiple blast aerator hopper system comprising:

a generally upright, rigid storage bin having walls, an outlet and an inlet;

a plurality of blast aerators mounted on said bin at radially spaced-apart intervals about the periphery thereof, each aerator comprising:

a generally cylindrical, rigid tank having an axis, and a front end fitted with a blast discharge opening coaxially aligned with respect to said axis;

a rigid, elongated, tubular, blast discharge pipe adapted to be coaxially secured and aligned within said tank, said pipe having a front output end, a rear end positioned interiorly of said tank, a counter-bored, internal front shoulder seat, and a predetermined intermediate internal diameter;

a piston seat assembly coaxially positioned within said blast discharge pipe in abutting relation with respect to said internal shoulder, said seat assembly including a rear, chamfered seat;

a resilient, generally cylindrical, dual diameter piston coaxially disposed within said blast discharge pipe and axially displaceable between an aerator tank fill position and an aerator tank exhaust position; a main body portion of said piston having a diameter substantially equal to said blast output pipe predetermined intermediate diameter and a front portion of said piston having a diameter less than said discharge pipe intermediate diameter and terminating in a front, chamfered portion adapted to matingly engage said piston seat assembly chamfered seat when said piston assumes said aerator fill position;

vent means defined in said blast discharge pipe for outputting air temporarily stored within said tank through said blast discharge pipe front output end in response to movement of said piston to said aerator tank exhaust position;

end cap means adapted to be coaxially, sealingly coupled to said blast discharge pipe rear end for limiting rearward axial displacement of said piston, the end cap means operable to define a sealed cavity between it and said piston at the rear of said blast discharge pipe; and, valve control means in fluid flow communication with said cavity for filling said cavity and thus said tank and for subsequently initiating an output blast by venting said cavity;

the first of said blast aerators mounted closest to said storage bin outlet, and each successive blast aerator being mounted higher than the previous blast aerator; and, timing means for initiating a timed sequence of air blasts by firing said blast aerators in a predetermined operational sequence.

2. The system as defined in claim 1 wherein each piston includes a shoulder defined between said main body portion thereof and said reduced diameter portion thereof, said shoulder forming a working surface against which tank pressure may urge said piston toward said rear end of said blast discharge pipe in response to venting of said cavity.

3. The system as defined in claim 2 wherein each valve control means comprises:

first air injection fitting means coupled to said end cap means for injecting air into said cavity rearwardly of said piston whereby to pressurize said cavity and move said piston into sealing engagement with said chamfered seat;

check valve means coupled to said end cap in fluid flow communication with said cavity for pressurizing the interior of said tank in response to pressurization of said cavity; and, solenoid valve means for first actuating said air injection fitting means whereby to fill said tank through said check valve means and then depressurizing said cavity at a preselected time whereby to suddenly exhaust said tank through said output pipe in response to resultant rearward displacement of said dual diameter piston.

4. The system as defined in claim 3 wherein each solenoid valve means is located exteriorly of said tank.

5. The system as defined in claim 4 wherein said timing means fires said first blast aerator first, and then successively fires the next higher blast aerator until a blast cycle is completed.

6. The system as defined in claim 5 including means for varying the time between successive firing of aerators.

7. The system as defined in claim 6 wherein each of the blast discharge pipes enters the storage bin at a downward, tangential angle with respect to said walls.

* * * * *